United States Patent [19]

Andrews et al.

[11] Patent Number: 4,848,668

[45] Date of Patent: Jul. 18, 1989

[54] FUEL INJECTION NOZZLES

[75] Inventors: Richard J. Andrews, Guildford; Godfrey Greeves, Hatch End, both of England

[73] Assignee: Lucas Industries Public Limited Company, Birmingham, England

[21] Appl. No.: 190,832

[22] Filed: May 6, 1988

[30] Foreign Application Priority Data

May 12, 1987 [GB] United Kingdom ..... 8711188

[51] Int. Cl.[4] ..... B05B 1/30

[52] U.S. Cl. ..... 239/533.5; 239/533.6; 239/533.9

[58] Field of Search ..... 239/533.3–533.12

[56] References Cited

U.S. PATENT DOCUMENTS

| | | | |
|---|---|---|---|
| 2,379,399 | 6/1945 | Haines | 239/533.3 |
| 4,382,553 | 5/1983 | Thoma et al. | 239/533.9 |
| 4,448,356 | 5/1984 | Nakajima et al. | 239/533.9 |
| 4,509,691 | 4/1985 | Skinner | 239/533.9 |

FOREIGN PATENT DOCUMENTS

| | | | |
|---|---|---|---|
| 2711390 | 9/1978 | Fed. Rep. of Germany | 239/533.9 |
| 1172861 | 2/1959 | France | 239/533.9 |
| 2188367 | 9/1987 | United Kingdom | 239/533.9 |

*Primary Examiner*—Andres Kashnikow
*Assistant Examiner*—Michael J. Forman
*Attorney, Agent, or Firm*—Balogh, Osann, Kramer, Dvorak, Genova & Traub

[57] ABSTRACT

An inwardly opening fuel injection nozzle includes a first spring which is coupled by means of a push rod to the valve member of the nozzle. The nozzle includes a second spring positioned between the first spring and the valve member and acting upon a slidable abutment member which is engaged by the valve member after a predetermined movement of the valve member away from a seating. The valve member is lifted against the first spring by fuel under pressure supplied to an inlet to allow restricted fuel flow through an outlet and further against the action of both springs as the pressure at the inlet increases to allow unrestricted flow through the outlet.

5 Claims, 2 Drawing Sheets

FUEL INJECTION NOZZLES

This invention relates to a fuel injection nozzle of the so-called inwardly opening type for supplying fuel to compression ignition engines the nozzle comprising a valve member movable in a bore in a nozzle body by fuel under pressure supplied to a fuel inlet, spring means for biasing the valve member into contact with a seating to prevent fuel flow through an outlet from said inlet, said spring means comprising a first spring which opposes the movement of the valve member by the fuel pressure throughout the range of movement of the valve member, and a second spring which acts to oppose the movement of the valve member after a predetermined movement thereof away from the seating.

Such a nozzle is particularly useful for use with certain types of compression ignition engine the operation of which is benefited by supplying the initial quantity of fuel at a restricted rate. However, since the restriction to the flow of fuel is formed by the gap between the valve member and the seating it is necessary to be able to adjust the aforesaid predetermined movement very accurately.

A nozzle of the kind described above is known from British Patent Specification No. 2071760B. In the aforesaid specification the adjustment of the so-called predetermined movement of the valve member is effected using a screw thread adjustment. In a typical nozzle the predetermined movement of the valve member can be as small as 0.05 mm with the total movement of the valve member 0.23 mm. Whilst the provision of a screw thread adjustment for the valve member seems attractive, in practice the adjustment is not easy to effect due to the need to provide lock nuts the tightening of which can cause distortion and hence disturbance of the setting.

The object of the present invention is to provide a nozzle of the kind specified in a simple and convenient form.

According to invention a fuel injection nozzle of the kind specified comprises first and second spring chambers formed in a part secured to the nozzle body, said spring chambers being located in spaced end to end relationship within the part, the first spring being located in the first chamber further from the nozzle body, a push rod engaged with one end of the first spring, said push rod extending through the second chamber into engagement with the valve member, the second spring being located in the second chamber, a hollow slidable spring abutment engaged by said second spring, said hollow spring abutment being positioned to be engaged by part of said valve member after a predetermined movement of the valve member away from the seating and a gap defined between the hollow spring abutment and said valve member when the valve member is in the closed position.

Figure 1:
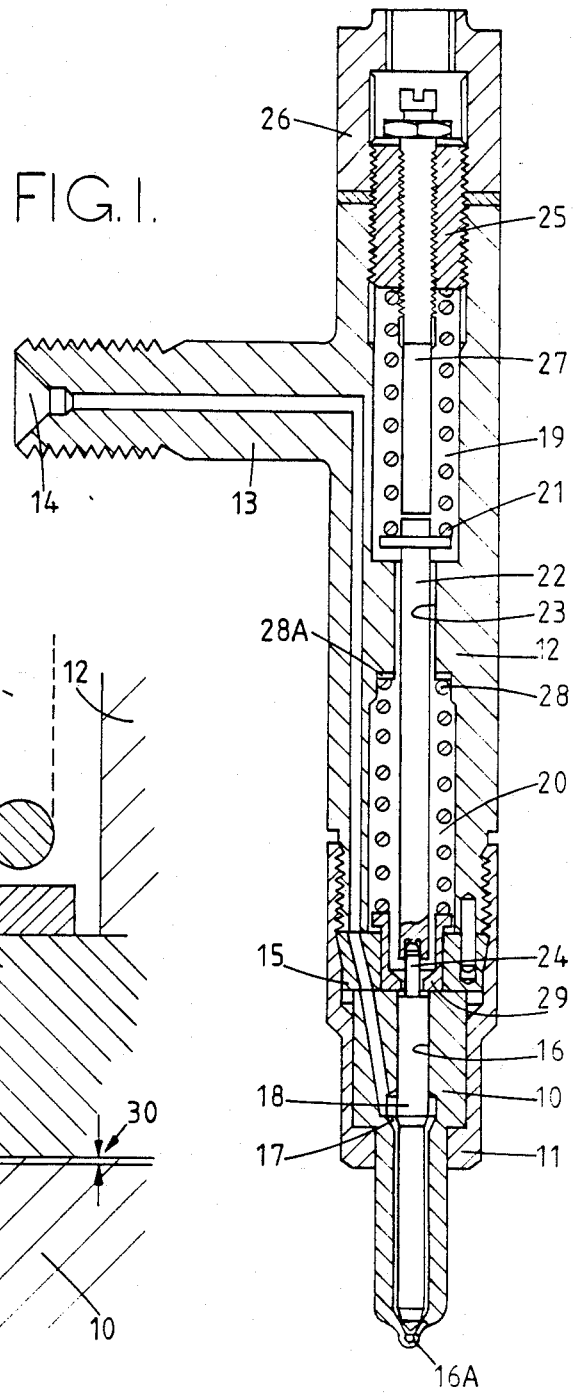
Figure 2:
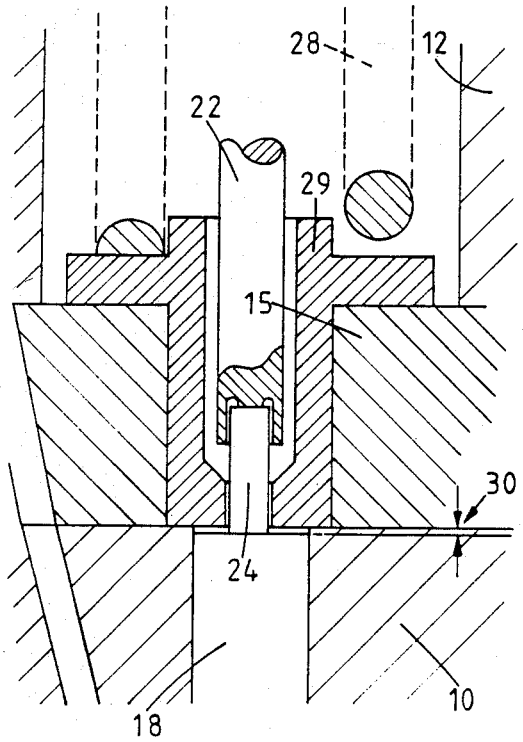
Figure 3:
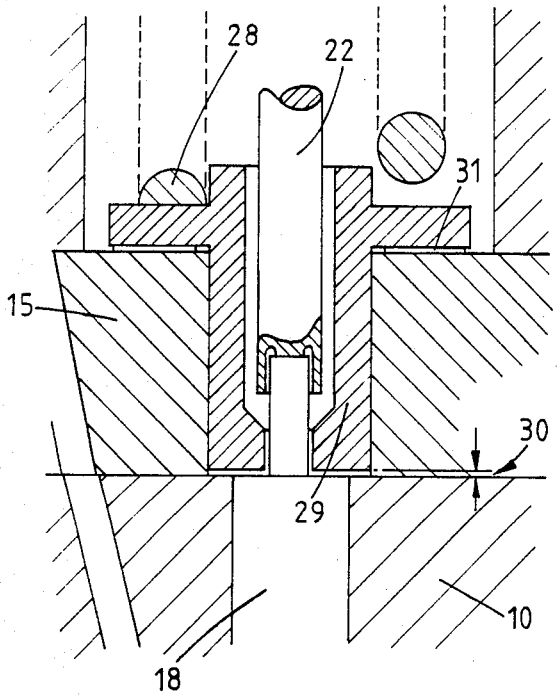
Figure 4:
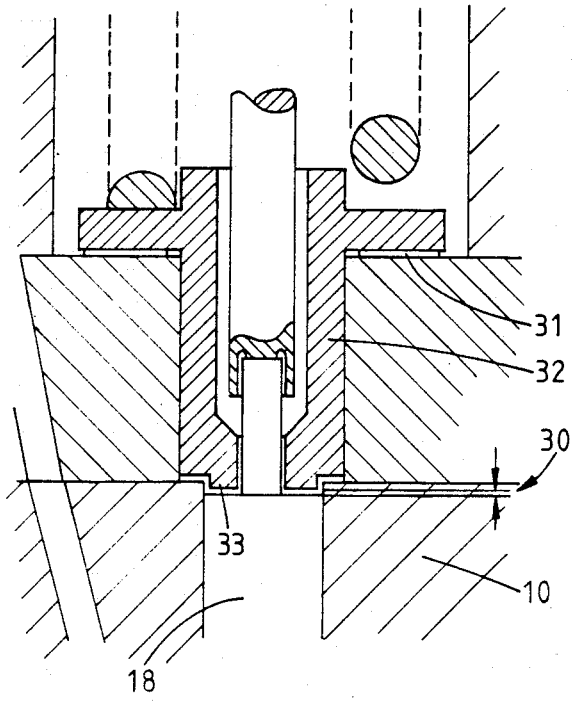

In the accompanying drawings:

FIG. 1 is a sectional side elevation of one example of a nozzle in accordance with the invention, FIG. 2 is a view to an enlarged scale of a portion of the nozzle seen in FIG. 1, and FIGS. 3 and 4 are views similar to FIG. 2 illustrating modifications.

Referring to FIG. 1 of the drawings the nozzle comprises a nozzle body 10 which is secured in known manner by means of a cap nut 11, to one end of a generally cylindrical nozzle holder 12 which in the example is provided with a transversely extending projection 13 which defines a fuel inlet 14. Interposed between the nozzle body and the holder is a spacer member 15.

Formed in the body 10 is a bore 16 which at its end remote from the holder defines a seating downstream of which is formed an outlet in the form of an outlet orifice 16A. Intermediate its ends the bore defines an enlargement 17 which is connected by communicating passages in the body, the spacer member and the holder, with the fuel inlet 14. Slidable in the bore is a valve member 18 the portion of which extending between the enlargement 17 and the seating, is of reduced diameter. The valve member is shaped for co-operation with the seating and the step defined on the surface of the valve member defines an area against which fuel under pressure supplied to the inlet 14 can act to generate a force to lift the valve member away from the seating thereby to allow fuel flow through the outlet orifice 16A.

Formed in the holder are a pair of chambers 19, 20 the chambers being located in spaced end to end relationship. The first chamber accommodates a coiled compression spring 21 one end of which bears against an abutment formed on the end of a push rod 22 which extends through a drilling 23 connecting the two chambers and through the chamber 20 to locate on a projection 24 formed as an extension of the valve member, the projection being of reduced diameter.

The other end of the spring 19 engages a plug 25 which is located in screw thread engagement within the end of the chamber 19 and which can be secured by means of a locking cap 26. The axial setting of the plug determines the force exerted upon the valve member by the spring 19 and it determines, as will be explained, the pressure of fuel which is required to lift the valve member 18 from the seating. Adjustably located within the plug 25 is a stop rod 27 which can be engaged by the push rod 22 to determine the maximum movement of the valve member away from the seating.

Located within the chamber 20 is a coiled compression spring 28, the spring at one end bearing against the step defined between the chamber and the drilling 23 and at its other engaging a tubular spring abutment 29 which is slidably mounted within a central aperture formed in the spacer member 15. The abutment 29 is larger in diameter than the valve member and, as shown in FIG. 2, can engage the nozzle body 10. In the example shown in FIGS. 1 and 2 a gap or clearance exists in the closed position of the valve member between the end of the valve member 18 and the spring abutment the clearance being indicated by the reference numeral 30.

In operation, when fuel under pressure is supplied to the inlet 14 a force is developed on the valve member and when the force is sufficient to overcome the force exerted by the spring 21, the valve member lifts from the seating against the action of the spring 21, the extent of lift being determined by the abutment of the valve member 18 with the spring abutment 29. The clearance 30 is therefore taken up and fuel is supplied to the associated engine at a restricted rate. As the fuel pressure at the inlet continues to increase there will be an increase in the force exerted upon the valve member and further movement of the valve member will occur when the force is sufficient to overcome the combined actions of the springs 21 and 28. The extent of further movement of the valve member is limited by the abutment of the push rod 22 with the stop rod 27.

Adjustment of the gap 30, which is critical, is effected by grinding the end face of the valve member 18 to increase the gap or the end face of the body 10 to reduce the gap. The gap 30 can therefore be set before the nozzle body is assembled to the holder using conventional gauging techniques or by checking the flow through the outlet orifice 16A. The force exerted by the spring 28 is determined by means of a shim or shims 28A positioned between the end of the spring 28 and the step defined at the end of the chamber 20. As previously stated, the nozzle opening pressure is adjusted by adjustment of the plug 25 and the maximum movement of the valve member is effected by adjusting the setting of the stop rod relative to the plug 25 once the setting of the plug 25 has been determined.

In the arrangement which is shown in FIG. 3 identical reference numerals are used but in this case the setting of the gap or clearance 30 is achieved by the use of a shim 31 which is located between the flanged portion of the spring abutment 29 and the spacer member 15. It will also be noted that in the closed position of the valve member the end face of the valve member 18 is flush with the end face of the body. With this arrangement therefore it is possible to gauge the gap 30 before the spacer member 15 and spring abutment 29 are assembled to the nozzle assembly.

In the arrangement shown in FIG. 4 the valve member 18 and the nozzle body 10 are conventional with the gap between the end of the nozzle body and the end face of the valve member 18 being appropriate for a conventional nozzle in which this distance determines the maximum lift of the valve member. The spring abutment 32 is modified by the provision of an annular projection 33 which extends into the bore which accommodates the valve member and it is the gap between the projection 33 and the end face of the valve member which forms the gap 30. Once again a shim 31 is utilized to determine the gap which as with the example of FIG. 3, can be set before assembly of the nozzle.

In each of the arrangements described the spring abutment 32 is a sliding fit within the aperture in the spacer member. If desired however the spring abutment can be a sliding fit about the projection 24 of the valve member with a gap defined between the outer surface of the abutment 32 and the wall of the aperture in the spacer member through which it extends.

The invention can also be applied to so-called "pencil" injectors in which the nozzle body is of increased length and the fuel inlet is formed in a lateral extension of the nozzle body. In this case the spring chambers are located in an elongated part which is in screw thread engagement with the body.

We claim:

1. A fuel injection nozzle of the inwardly opening type comprising a nozzle body, a bore formed in the nozzle body and a valve member movable therein by fuel under pressure supplied to a fuel inlet, a seating defined in said bore, spring means for biasing said valve member into contact with said seating to prevent flow of fuel through an outlet from said inlet, an elongated nozzle holder, a distance piece located intermediate one end face of said nozzle body and one end face of said holder, means securing said nozzle body, said distance piece and holder in assembled relationship, first and second spring chambers defined in end to end relationship in said nozzle holder, said first chamber being remote from said nozzle body, said spring means comprising a first coiled compression spring located in said first chamber, a push rod extending through said second chamber and through an aperture in said distance piece, a first spring abutment carried by said push rod and engaging one end of said first spring, said push rod being engaged about a reduced end portion of said valve member which extends from an end of said valve member remote from said seating, a second coiled compression spring located in said second chamber, an elongated tubular second spring abutment engaged by said second spring, said second spring abutment being slidably located in and guided by the wall of said aperture in said distance piece, said second spring abutment having an outer diameter which is greater than the diameter of said valve member and an inner diameter which is smaller than the diameter of said valve member, means limiting the extent of movement of said second spring abutment towards said nozzle body and a gap defined between said second spring abutment and said valve member when said valve member is in contact with said seating.

2. A nozzle according to claim 1 characterized in that in the closed position of said valve member, said second spring abutment is in engagement with said nozzle body, a gap formed by machining said valve member and said end face of said nozzle body such that one end of said valve member lies below an end face of said nozzle body.

3. A nozzle according to claim 1 characterized in that said second spring abutment is provided with a flange adjacent to an end surface of said distance piece, between which is located a shim, the thickness of which is chosen to provide said gap when the valve member is in contact with said seating.

4. A nozzle according to claim 3 characterized in that said end face of said valve member is flush with said end surface of said body.

5. A nozzle according to claim 3 characterized in that said end of said valve member lies below said end surface of said body in the closed position of said valve member, said second spring abutment defining an annular projection which extends into said bore for engagement by said valve member.

* * * * *